US009517874B2

(12) United States Patent
Koyanagi

(10) Patent No.: US 9,517,874 B2
(45) Date of Patent: Dec. 13, 2016

(54) VALVE STRUCTURE

(75) Inventor: Yoshifumi Koyanagi, Kashiwara (JP)

(73) Assignee: KASHIWARA SEITAI CO., LTD., Kashiwara-Shi (JP)

( * ) Notice: Subject to any disclaimer, the term of this patent is extended or adjusted under 35 U.S.C. 154(b) by 632 days.

(21) Appl. No.: 13/301,330

(22) Filed: Nov. 21, 2011

(65) Prior Publication Data

US 2012/0148174 A1 Jun. 14, 2012

(30) Foreign Application Priority Data

Dec. 13, 2010 (JP) ..... 2010-277187

(51) Int. Cl.
*B65D 33/01* (2006.01)
*B65D 81/20* (2006.01)
*B65D 85/16* (2006.01)

(52) U.S. Cl.
CPC ..... *B65D 81/2038* (2013.01); *B65D 85/16* (2013.01)

(58) Field of Classification Search
CPC ... B65D 85/16; B65D 81/2038; B65D 81/052; B65D 31/145; B65D 33/01; B65D 31/14
USPC ..... 383/100, 101, 102, 103, 44, 45, 36; 137/846, 223, 313, 852, 843, 848, 853, 137/851, 246, 15.17, 522, 844; 206/524.8; 493/213; 446/224; 156/290
See application file for complete search history.

(56) References Cited

U.S. PATENT DOCUMENTS 4,842,007 A * 6/1989 Kurtz ..... A63H 27/10 137/223
5,209,264 A * 5/1993 Koyanagi ..... 137/852
5,558,441 A * 9/1996 Morrison et al. ..... 383/100
5,595,521 A * 1/1997 Becker ..... 446/224
5,927,336 A 7/1999 Tanaka et al.
2002/0079242 A1 6/2002 Ohtsubo et al.
2004/0114837 A1 6/2004 Koyanagi
2007/0056647 A1* 3/2007 Frayne ..... 137/843
2010/0038275 A1* 2/2010 Tschantz ..... 206/522

FOREIGN PATENT DOCUMENTS

CN 1152528 A 6/1997
CN 1365940 A 8/2002
CN 1458897 A 11/2003
JP 5-6265 U 1/1993
JP 4445879 B2 4/2010

* cited by examiner

*Primary Examiner* — Jes F Pascula
*Assistant Examiner* — Matthew Theis
(74) *Attorney, Agent, or Firm* — Birch, Stewart, Kolasch & Birch, LLP

(57) ABSTRACT

To provide a valve structure in which a valve sheet is not fused to outer sheets when heat-sealing to a sealed bag. The left and right sides of three valve constituting sheets are side-sealed, and opposed valve constituting sheets are brought into close contact with each other to restrict a fluid from moving. The inside and outside of a bag body are partitioned by a partition seal, the valve is disposed across the inside and outside of the bag body, and welded to the bag body by the partition seal. One of the opposed surfaces of the valve constituting sheets is formed of a non-weldable film that is not welded by welding of the side seals and the partition seal. The side seals become non-welded portions and side-entering preventive sealed portions that block flows of the fluid into the movement channel are provided continuously to the partition seal.

20 Claims, 7 Drawing Sheets

(A)

(B)

(A)

(B)

VALVE STRUCTURE

TECHNICAL FIELD

The present invention relates to a valve structure.

BACKGROUND ART

To an opening for discharging or introducing contents of a sealed bag that can be used for various purposes such as a sealed bag to be used for storing a fluid such as a liquid or gas or for storing futons and clothes, etc., by removing air from the inside, or used as a cushioning material that utilizes a cushioning effect of gas sealed within a small partitioned storing portion, a check valve is attached in order to accomplish the purposes (Patent Documents 1 and 2).

The check valve limits the direction of the flow of a fluid such as a gas or liquid inside and outside the storing portion of the bag to only one direction.

There is a check valve, in particular, to be used for preventing air from switching with a liquid and flowing into a sealed bag when the liquid is discharged from the sealed bag, etc., storing the liquid (Patent Document 2).

In detail, the check valve includes two outer sheets and a valve sheet each made of synthetic resin, and the outer sheets are layered with the valve sheet therebetween, and in the state where the direction of a flow channel for discharging or storing contents with respect to the sealed bag is set to the up-down direction, the left end sides of the both outer sheets are heat-sealed to each other and the right end sides of the outer sheets are heat-sealed to each other, the base end side of the valve sheet is fixed to the inner surface of one outer sheet, and the portion between the inner surface of the other outer sheet and the surface on the opposite side of the fixed surface of the valve sheet forms a flow channel.

When this check valve is attached to the sealed bag, both inner surfaces near the opening of the sealed bag are layered on the outer surfaces of both outer sheets and heat-sealed.

During the heat-sealing for attaching the check valve to the sealed bag, the valve sheet sandwiched between the both outer sheets must be prevented from being heat-sealed to the outer sheets.

Therefore, the inventor of the present invention considered a measure in which a heat-resistant ink is printed on the surface on which the flow channel of the valve sheet is formed.

As a heat-resistant ink, an ink considered safe to the human body is used, however, if the contents are foods, due to the contact of the ink with the contents, safety cannot be guaranteed, and this is not permitted.

A manufacturer of the check valve must place an order with an outsourced printer for printing of the heat-resistant ink, and the number of lots to be ordered must be large to a certain extent, so it is difficult to place an order with an outsourced printer for printing of the heat-resistant ink in a small number of lots.

Therefore, further, instead of printing of a heat-resistant ink, the inventor of the present invention considered that the valve sheet was formed by laminating a film (sheet) made of a material that was not heat-weldable to the outer sheets on the surface constituting the flow channel of the valve sheet.

However, by providing a film that is not heat-weldable, problems have been found that, when manufacturing the valve, the inner surfaces of the outer sheets constituting the flow channel and the valve sheet opposed to the inner surfaces cannot be reliably heat-sealed, and non-sealed portions that are not sealed are formed between the left end sides of the outer sheets and the valve sheet and between the right end sides of the outer sheets and the valve sheet, and at these non-sealed portions, the airtightness of the sealed bag is lost, and contents leak or the outside air is introduced into the sealed bag from the non-sealed portions.

PRIOR ART DOCUMENT

Patent Documents

Patent Document 1

Japanese Patent No. 4445879

Patent Document 2

Japanese Published Unexamined Utility Model Application No. H05-6265

SUMMARY OF THE INVENTION

Problems to be Solved by the Invention

The present invention prevents a valve sheet from being fused to outer sheets without using the method in which a heat-resistant ink is printed when heat-sealing the valve to a sealed bag. Further, the present invention solves the above-described problems by providing a means that prevents the valve from losing the airtightness of the sealed bag.

Means for Solving the Problems

A first aspect of the present invention provides a valve structure including a valve and a bag body made of sheets, wherein the valve includes a plurality of valve constituting sheets disposed in layers each other, and a portion between opposed surfaces of at least two valve constituting sheets opposed to each other and layered together of the plurality of valve constituting sheets is a fluid movement channel. In a state where the movement direction from the upstream to the downstream of the fluid is set to the up-down direction, the left and right of the movement channel is defined by side seals, and the side seals are formed by welding the opposed valve constituting sheets to each other, and by bringing the opposed valve constituting sheets into close contact with each other, the fluid in the movement channel is restricted from moving, and the inside and the outside of the bag body are partitioned by a partition seal extending in a direction across the movement channel. The valve is disposed across the inside and the outside of the bag body, and adopts the following valve structure welded to the bag body by the partition seal.

That is, at least one of the opposed surfaces of the opposed valve constituting sheets is formed of a non-weldable film that is not welded by welding of the side seals and the partition seal at a point including the same position as the partition seal. The non-weldable film is laminated on the opposed surface of the valve constituting sheet directly or indirectly via another film, and is disposed across the left and right side seals. The side seals are non-welded portions that are not welded at the portion of the non-weldable film. On the more downstream side than the partition seal in a forward flow of a fluid, on the outer sides in the left-right direction of the non-welded portions, side-entering preventive sealed portions that block flows of the fluid into the movement channel from the non-welded portions are provided continuously to the partition seal.

Here, the forward flow means movement of the fluid in a direction that the valve should originally allow regardless of whether the valve is a check valve. For example, when the sealed bag W is a balloon and the fluid is air injected for inflating the balloon, the movement of the air from the outside to the inside of the balloon is the forward flow. When the sealed bag W is a deaerated bag for storing clothes and the fluid is air to be discharged for deaeration from the deaerated bag, the movement of the air from the inside to the outside of the deaerated bag is the forward flow. A valve other than a check valve is a valve that is formed of two valve constituting sheets and closes the channel of the fluid by close contact of both valve constituting sheets, described with use of FIG. 5(D) and FIG. 5(E) later by way of example, and in the case of this valve other than a check valve, the movement of a fluid in a direction that the valve originally allows is also defined as the forward flow.

A second aspect of the present invention provides a valve structure wherein the side-entering preventive sealed portions block flows from the non-welded portions into the movement channel and blocks a flow of the fluid from the non-welded portions to the outside of the movement channel in the first aspect of the present invention.

A third aspect of the present invention provides a valve structure wherein the side-entering preventive sealed portions are formed integrally with the partition seal, and extended from the partition seal toward the downstream side in the forward flow in the first or second aspect of the present invention.

According to a fourth aspect of the present invention, the side-entering preventive sealed portions are formed integrally with the partition seal, and extended from the partition seal toward both the downstream side and the upstream side in the forward flow, and the side-entering preventive sealed portions partially overlap the side seals in the first or second aspect of the present invention.

A fifth aspect of the present invention adopts a valve structure configured as follows in the valve structure according to any of the first to fourth aspects of the present invention.

That is, the valve is a check valve formed of at least three valve constituting sheets, and among the valve constituting sheets, at least two valve constituting sheets are outer sheets, and at least the other one valve constituting sheet is a valve sheet, both outer sheets are layered with the valve sheet therebetween, and on the both outer sheets and the valve sheet, the side seals are formed. On the valve sheet, the upstream side in the forward flow of the fluid is a fixed end fixed to one outer sheet, and the downstream side is a free end that is not fixed, and a portion between opposed surfaces of the valve sheet and the other outer sheet or another valve sheet opposed to the valve sheet is the fluid movement channel, and the non-weldable film is laminated on at least one of the opposed surfaces directly or indirectly via another film.

According to a sixth aspect of the present invention, the valve is formed of two valve constituting sheets, both valve constituting sheets are formed to be tubular by the side seals, and a portion between opposed surfaces of the two valve constituting sheets is the fluid movement channel, and the non-weldable film is laminated on at least one of the opposed surfaces directly or indirectly via another film in the valve structure according to any of the first to fourth aspects of the present invention.

According to a seventh aspect of the present invention, in the fluid movement channel, a filter sheet is provided to filtrate the fluid moving between the valve constituting sheets in the valve structure according to any of the first to sixth aspects of the present invention.

An eighth aspect of the present invention provides a valve structure including a valve and a bag body formed of sheets, wherein the valve is formed of two valve constituting sheets, both valve constituting sheets are formed to be tubular by the side seals, a portion between opposed surfaces of the two valve constituting sheets is the fluid movement channel, and in a state where the movement direction from the upstream to the downstream of the fluid is set to the up-down direction, the left and right of the movement channel are defined by the side seals, and the side seals are formed by welding the opposed valve constituting sheets to each other, the fluid in the movement channel is restricted from moving by close contact of the opposed valve constituting sheets, the inside and the outside of the bag body are partitioned by a partition seal extending in a direction across the movement channel, and the valve is disposed across the inside and the outside of the bag body, and adopts the following valve structure welded to the bag body by the partition seal.

That is, at least one of the opposed surfaces of the opposed valve constituting sheets is formed of a non-weldable film that is not welded by welding of the side seals and the partition seal at a point including the same position as the partition seal. The non-weldable film is laminated on the opposed surface of the valve constituting sheet directly or indirectly via another film. The side seals are non-welded portions that are not welded at the portion of the non-weldable film. On at least one of the sides more inward and more outward than the partition seal of the sealed bag, side-entering preventive sealed portions that block flows of a fluid from the non-welded portions into the movement channel are provided continuously to the partition seal on the outer sides in the left-right direction of the non-welded portions.

Effects of the Invention

According to the first to eighth aspects of the present invention, by providing the non-weldable film, the fluid movement channel is prevented from being sealed by formation of the partition seal. Further, at the non-welded portions (non-welded sections) provided on the side seals of the valve constituting sheets by the non-weldable film, a fluid other than the fluid flowing forward in the movement channel can be prevented from flowing into the movement channel from the outside of the fluid movement channel through the non-welded portions by the side-entering preventive sealed portions.

According to the second aspect of the present invention, a fluid flowing forward can also be prevented by the side-entering preventive sealed portions from flowing out to the outside of the fluid movement channel through the non-welded portions.

By the non-weldable film, the fluid movement channel can be prevented from being shut off by the formation of the partition seal, and printing of a heat-resistant ink becomes unnecessary. The heat-resistant ink is unnecessary, so that the problem of the guarantee of safety of the heat-resistant ink to the human body is resolved, and separation of the heat-resistant ink before heat-sealing does not occur, and there is no need to place an order with an outsourced printer for printing of the heat-resistant ink, and therefore, a flexible response to production of a small number of lots is possible.

Further, there is no need to print the heat-resistant ink, and accordingly, the check valve can be freely designed.

BEST MODE FOR CARRYING OUT THE INVENTION

Figure 1:
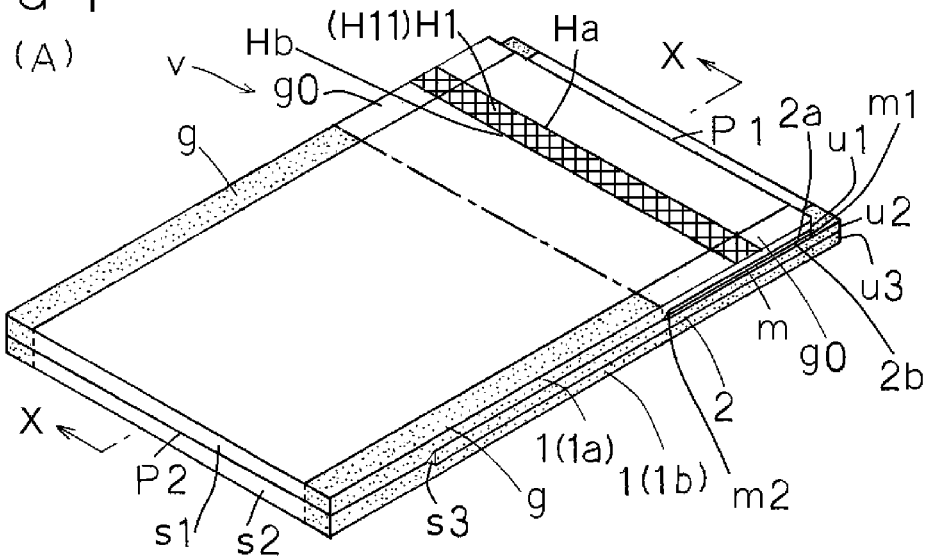
FIG. 1(A) is a perspective view of a valve according to a preferred embodiment of the present invention attached to a sealed bag.
FIG. 1(B) is an end view taken along line X-X in FIG. 1(A).
Figure 1:
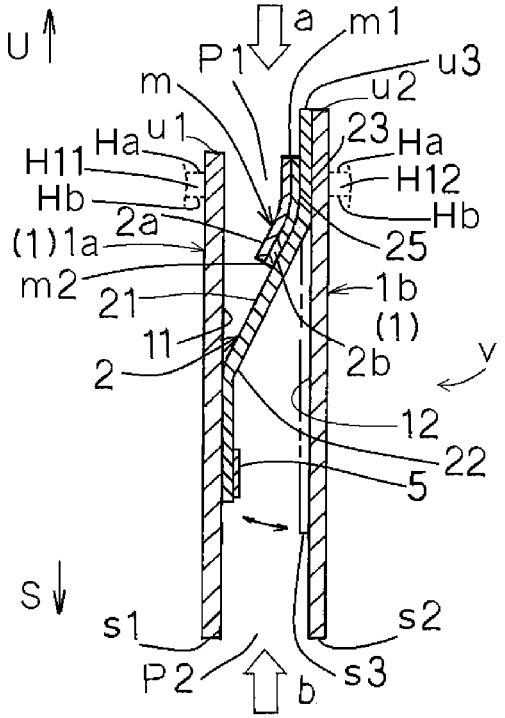

Hereinafter, preferred embodiments of a structure for attaching a valve V to a sealed bag W according to the present invention will be described with reference to the drawings.

For convenience of description, U denotes up and S denotes down in each drawing.

In addition, "up, down, left, and right" mentioned herein show only relative position relationships, and do not show absolute positions. For example, it is perfectly acceptable that the up-down direction mentioned herein is the left-right direction in actuality.

In the present preferred embodiment, a valve V is provided on the lower end side of the sealed bag W.

In a forward flow of a fluid to be stored in the sealed bag W or discharged from the sealed bag W, the upstream side is the upper U side, and the downstream side is the lower S side.

In the present preferred embodiment, the sealed bag W is for storing a fluid such as a liquid. The valve V to be attached to the sealed bag W is a check valve that is provided to prevent contents from flowing back and prevent air from being introduced into the inside when the contents are discharged.

In addition, in FIG. 1(A), in order to avoid a complicated drawing, in the sealed bag W to which the valve V is attached, bag sheets W1 and W2 constituting the sealed bag W are not shown, and only sealed positions between the valve V and the sealed bag W are shown.

As shown in FIG. 1(A) and FIG. 1(B), this valve V includes three valve constituting sheets that are each rectangular synthetic resin sheets. Among the three valve constituting sheets, two are outer sheets 1 and 1, and the remaining one is a valve sheet 2.

The widths of the three sheets of the both outer sheets 1 and 1 and the valve sheet 2 in a direction orthogonal to the fluid movement direction inside the valve V are substantially equal to each other. Specifically, the widths in the left-right direction of the three sheets of the both outer sheets 1 and 1 and the valve sheet 2 are substantially the same.

In a state where the up-down direction U, S is a flow channel direction of a fluid passing through the check valve V, the two outer sheets 1 and 1 are layered with the valve sheet 2 therebetween. After the outer sheets are thus layered, the left end sides of the sheets 1, 2, and 1 are heat-sealed to each other and the right end sides of the sheets are heat-sealed to each other.

Description is given in detail by defining one of the outer sheets 1 and 1 as a first sheet 1*a* and the other thereof as a second sheet 1*b*.

The left end side of the first sheet 1*a*, the left end side of the valve sheet 2, and the left end side of the second sheet 1*b* are integrated by the heat-sealing. The right end side of the first sheet 1*a*, the right end side of the valve sheet 2, and the right end side of the second sheet 1*b* are integrated by the heat-sealing.

The portion to which the heat-sealing is applied to each valve constituting sheet of the valve V is referred to as a heat-sealed portion g as appropriate, and is shown with spots in each drawing.

As shown in FIG. 1(B), the portion between the upper end sides and the portion between the lower end sides of the first sheet 1*a* and the second sheet 1*b* are opened to form openings P1 and P2, respectively.

As shown in FIG. 1(B), the upstream side of the valve sheet 2 in the forward flow of a fluid moving inside the valve V is a fixation portion 23 fixed to one of the outer sheets 1. The downstream side in the forward flow of the fluid moving inside the valve V is a free end that is not fixed to the outer sheets 1 and 1. When sealing the bag sheets W1 and W2 of the sealed bag W described later to each other, concurrently with this sealing, the fixation portion 23 is formed by welding. Therefore, in the valve V before being attached to the sealed bag W, the fixation portion 23 of the valve sheet 2 does not exist.

Of course, the bag sealed portion H described later does not exist when manufacturing the valve V.

As shown in FIG. 1(B), after the fixation portion 23 of the valve sheet 2 is formed when sealing for attaching the valve V to the sealed bag W, the fixation portion 23 shuts off the portion between the second sheet 1*b* and the valve sheet 2 in the up-down direction, and prevents the fluid from flowing back between the valve sheet 2 and the second sheet 1*b*.

In detail, in this check valve V, as shown in FIG. 1(B), the fluid a that entered the portion between the first and second sheets 1*a* and 1*b* from the upper end opening P1 of the first and second sheets 1*a* and 1*b* passes through the portion between the inner side surface of the first sheet 1*a* and the valve sheet 2 and can exit from the portion between the first and second sheets 1*a* and 1*b* through the lower end opening P2 as a forward flow. The inner side surface of the first sheet 1*a* is an opposed surface 11 of the first sheet 1*a*. The surface facing the opposite side of the second sheet 1*b* side of the valve sheet 2 is an opposed surface 21 of the valve sheet 2. The portion between the opposed surfaces 11 and 21 of the first sheet 1*a* and the valve sheet 2 is a fluid movement channel. During forward flow movement inside this movement channel, as shown by the alternate long and two short dashed line in FIG. 1(B), the free end side of the valve sheet 2 separates from the opposed surface 11 of the opposed first sheet 1*a*. Then, the free end side of the valve sheet 2 fits along the inner side surface 12 of the second sheet 1*b* including the valve sheet 2.

Relative to the forward flow, a back flow is the movement of the fluid b opposite to the forward flow, from the lower end opening P2 of the first and second sheets 1*a* and 1*b* to the portion between the first and second sheets 1*a* and 1*b*.

As shown by the solid lines in FIG. 1(B), by close contact of the free end (tip end side, that is, the lower end side in the present preferred embodiment) of the valve sheet 2 with the opposed surface 11 of the first sheet 1*a*, the back flow is blocked by the fixation portion 23 of the valve sheet 2 formed when attaching to the sealed bag W. As a result, the back flow cannot exit from the upper end opening P1 to the outside of the check valve. The fixation portion 23 of the valve sheet 2 prevents the back flow from occurring.

In the present preferred embodiment, as shown in FIG. 1(B), the valve sheet 2 is fixed to the second sheet 1*b*. The upstream side end portion u2 in the forward flow of the second sheet 1*b* is positioned on the more upstream side than the upstream side end portion u1 of the first sheet 1*a*. Specifically, in the example of FIG. 1, the upper end of the second sheet 1*b* is positioned higher than the upper end of the first sheet 1*a*.

In the fluid movement direction, the downstream side end portions s1 and s2 of the first sheet 1*a* and the second sheet 1*b* are in the same position with respect to each other.

In this preferred embodiment, the upstream side end portion u3 of the valve sheet 2 is at the same position as the upstream side end portion u2 of the second sheet 1*b* in the fluid movement direction. Specifically, the upper end of the valve sheet 2 is at the same position as the upper end of the second sheet 1*b* in the fluid movement direction.

Further, the downstream side end portion s3 of the valve sheet 2 is positioned on the more upstream side than the downstream side end portions s1 and s2 of the first and second sheets 1*a* and 1*b*. Specifically, in the example of FIG. 1, the lower end of the valve sheet 2 is positioned higher than the lower ends of the first and second sheets 1*a* and 1*b*.

However, as shown in FIG. 5(A), the upstream side end portions u1 and u2 of the first sheet 1*a* and the second sheet 1*b*, that is, the upper ends of the first sheet 1*a* and the second sheet 1*b* may be set at the same position in the fluid movement direction. The position of the upstream side end portion u3 of the valve sheet 2, that is, the upper end of the valve sheet 2 can also be positioned on the more downstream side than the upstream side end portion u2 of the second sheet 1*b*.

The surface on the opposite side of the opposed surface 21 on the free end side of the valve sheet 2, that is, the surface facing the second sheet 1*b* is a non-opposed surface 22, and as shown in FIG. 1(B), on the non-opposed surface 22 of the valve sheet 2, a close-contact preventive portion 5 for making close contact difficult between the valve sheet 2 and the second sheet 1*b* including the valve sheet 2 is provided. When this close-contact preventive portion 5 is provided, the valve sheet 2 easily separates from the second sheet 1*b*. Specifically, the free end side of the valve sheet 2 smoothly approaches to and separates from the first sheet 1*a*, and the return checking effect of the check valve securely functions. As this close-contact preventive portion 5, a film of a resin with excellent peel property such as silicon resin can be used by way of example, however, without limiting to this, it can be carried out in various forms such as a resin film with excellent peel property laminated integrally on the valve sheet 2. This close-contact preventive portion 5 may be provided not on the side of the valve sheet 2 but on the second sheet 1*b*. However, the close-contact preventive portion 5 may not be provided.

When attaching the valve V to the sealed bag W, a seal limiting sheet m is provided so as to cover a position at which the partition seal H1 described later is across the valve, that is, a position at which a first branch portion H11 and a second branch portion H12 described later are across the valve.

The seal limiting sheet m is a sheet formed separately of the first and second sheets 1*a* and 1*b* and the valve sheet 2, and this seal limiting sheet m is formed of a non-weldable film 2*a* and a weldable film 2*b* layered together by lamination.

The non-weldable film 2*a* is made of a material that is not weldable to the first sheet 1*a*. The weldable film 2*b* is made of a material that is weldable to the second sheet 1*b*.

As a method for the lamination, a known lamination method such as a method using an adhesive other than heat-sealing is adopted.

By forming the side sealed portions g, the weldable film 2*b* side of the seal limiting sheet m is side-sealed to the opposed surface of the valve sheet 2. Thus, the surface side of the non-weldable film 2*a* is directed toward the opposed surface 11 of the first sheet 1*a*.

Then, by sealing the first bag sheet W1 and the second bag sheet W2 for forming the sealed bag W described later, as shown in FIG. 1(B), FIG. 4(B) and FIG. 4(C), concurrently with this sealing, an auxiliary fixation portion 25 is formed between the weldable film 2*b* of the seal limiting sheet m and the valve sheet 2, and the weldable film 2*b* and the valve sheet 2 are sealed to each other by the auxiliary fixation portion 25.

In the fluid movement direction, the width between the upstream side end portion m1 and the downstream side end portion m2 of the seal limiting sheet m is equal to or larger than the width in the fluid movement direction of the partition seal H1. Specifically, in the fluid movement direction, the up-down width of the seal limiting sheet m is equal to or larger than the up-down width of a transverse seal H5 described later of the partition seal H1.

When the width in the fluid movement direction of the seal limiting sheet m is equal to the width in the fluid movement direction of the partition seal H1, the seal limiting sheet m is disposed so as to coincide with the partition seal Hl in the fluid movement direction (not shown). In detail, in the fluid movement direction, the upstream side end portion m1 of the seal limiting sheet m is set at the same position as the upstream side end portions Ha of the first branch portion H11 and the second branch portion H12 described later of the transverse seal H5 of the partition seal H1. The downstream side end portion m2 of the seal limiting sheet m is set at the same position as the downstream side end portions Hb of the first branch portion H11 and the second branch portion H12 of the transverse seal H5 of the partition seal H1.

When the width in the up-down direction, that is, in the fluid movement direction of the seal limiting sheet m is larger than the width in the fluid movement direction of the partition seal H1, that is, the width in the up-down direction of the transverse seal H5, as shown in FIG. 1(B), the seal limiting sheet m is disposed so as to include the partition seal H1 in the fluid movement direction. For example, in the fluid movement direction, the upstream side end portion m1 of the seal limiting sheet m is disposed on the more upstream side than the upstream side end portions Ha of the transverse seal H5, that is, the first branch portion H11 and the second branch portion H12. The downstream side end portion m2 of the seal limiting sheet m is disposed on the more downstream side than the downstream side end portions Hb of the transverse seal H5. However, when the up-down width in the fluid movement direction of the seal limiting sheet m is larger than the up-down width of the transverse seal H5 of the partition seal H1, the upstream side end portion m1 of the seal limiting sheet m may be at the same position as the upstream side end portions Ha of the partition seal H1. On the other hand, the downstream side end portion m2 of the seal limiting sheet m may be at the same position as the downstream side end portions Hb of the partition seal H1. Either case is possible as long as the partition seal H1 does not protrude out from the seal limiting sheet m in the fluid movement direction.

As in the sealed bag W shown in FIG. 1 to FIG. 4 and FIG. 5(A), in the case where the partition seal H1 crosses the fluid movement direction in the valve sheet 2 of the valve V, as shown in these drawings, the seal limiting sheet m can be provided on the valve sheet 2. In the example shown in FIG. 1 to FIG. 4 and FIG. 5(A), the seal limiting sheet m is provided on the opposed surface 21 of the valve sheet 2. As shown in FIG. 4(B), FIG. 4(C) and FIG. 5(A), by welding the surface of the weldable film 2*b* to the opposed surface 21 of the valve sheet 2 at the fixation portion 23, the surface of the non-weldable film 2*a* is directed toward the opposed surface 11 of the first sheet 1*a*.

The first and second sheets 1*a* and 1*b* must be fused to each other, so that both of these sheets are made of polyethylene. The valve sheet 2 is also made of polyethylene. In this case, the non-weldable film 2*a* of the seal limiting sheet m is made of PET, and the weldable film 2*b* is made of polyethylene.

However, when the first sheet 1*a* and the non-weldable film 2*a* are not welded to each other, and the valve sheet 2 and the weldable film 2*b* are welded to each other, the materials of these are not limited to polyethylene and PET, and other materials may also be adopted and formed. Specifically, the material of the non-weldable film 2*a* is not limited to PET, and may be any material as long as the material has no heat sealing characteristics, in other words, the material is not welded by heat sealing. For example, while the weldable film 2*b* is made of polyethylene, the non-weldable film 2*a* may be made of nylon as well as PET.

As shown in FIG. 1(B), in the fluid movement direction, the upstream side end portion m1 of the seal limiting sheet m is positioned on the more downstream side than the upstream side end portions u3 and u2 of the valve sheet 2 and the second sheet 1*b*, however, it may be at the same position as the upstream side end portions u3 and u2 of the valve sheet 2 and the second sheet 1*b*. Specifically, in the present preferred embodiment, in the fluid movement direction, the upper end of the seal limiting sheet m is positioned lower than the upper ends of the valve sheet 2 and the second sheet 1*b*, however, it may be at the same position as the upper ends of the valve sheet 2 and the second sheet 1*b*.

The requirement is that the width and location in the fluid movement direction of the seal limiting sheet m are adopted to be equal to or include the width in the fluid movement direction of the partition seal H1. In other words, the width and location in the up-down direction of the seal limiting sheet m are adopted to be equal to or include the width in the up-down direction of the transverse seal H5 of the partition seal H1.

As shown in FIG. 1 to FIG. 4, by forming the side sealed portions g, the left and right end sides of the inner side surface of the second sheet 1*b* and the left and right end sides of the non-opposed surface 22 of the valve sheet 2 are properly sealed (side-sealed) across the entire up-down width of the valve sheet 2. The downstream sides, that is, the sides lower than the valve sheet 2 of the left and right end sides of the inner side surface of the second sheet 1*b* are properly sealed to the left and right end sides of the inner side surface of the first sheet 1*a*. Further, by forming the side sealed portions g, both left and right sides of the opposed surface of the valve sheet 2 and the left and right end sides of the opposed surface of the first sheet 1*a* are properly sealed in a section in which the seal limiting sheet m is not provided. The surface of the non-weldable film 2*a* of the seal limiting sheet m and the opposed surface 11 of the first sheet 1*a* are not properly sealed by formation of the side sealed portions g, but become non-welded portions g0. The surface of the weldable film 2*b* of the seal limiting sheet m and the opposed surface 21 of the valve sheet 2 are properly sealed.

In FIG. 1(A), densely spotted areas are regions that are properly airtight-sealed by the side sealed portions g, and sparsely spotted areas are the non-welded portions g0 that are regions not properly sealed or not sealed at all even by heat-sealing for forming the side sealing portions g, and are insufficiently airtight.

In the example shown in FIG. 1 to FIG. 4, as illustrated, in the fluid movement direction, the downstream side end portion s3 of the valve sheet 2 is positioned on the more upstream side than the downstream side end portions s1 and s2 of the first sheet 1*a* and the second sheet 1*b*. The downstream side end portion s3 of the valve sheet 2 may be at the same position as the downstream side end portions s1 and s2 of the first sheet 1*a* and the second sheet 1*b* or positioned on the more downstream side than the downstream side end portions s1 and s2 of the first sheet 1*a* and the second sheet 1*b* although this is not shown. Specifically, in the fluid movement direction, the illustrated lower end of the valve sheet 2 is positioned higher than the lower ends of the first sheet 1*a* and the second sheet 1*b*, however, the lower end of the valve sheet may be at the same position as the downstream side end portions s1 and s2 of the first sheet 1*a* and the second sheet 1*b* or lower than the downstream side end portions s1 and s2 of the first sheet 1*a* and the second sheet 1*b*.

Figure 6:
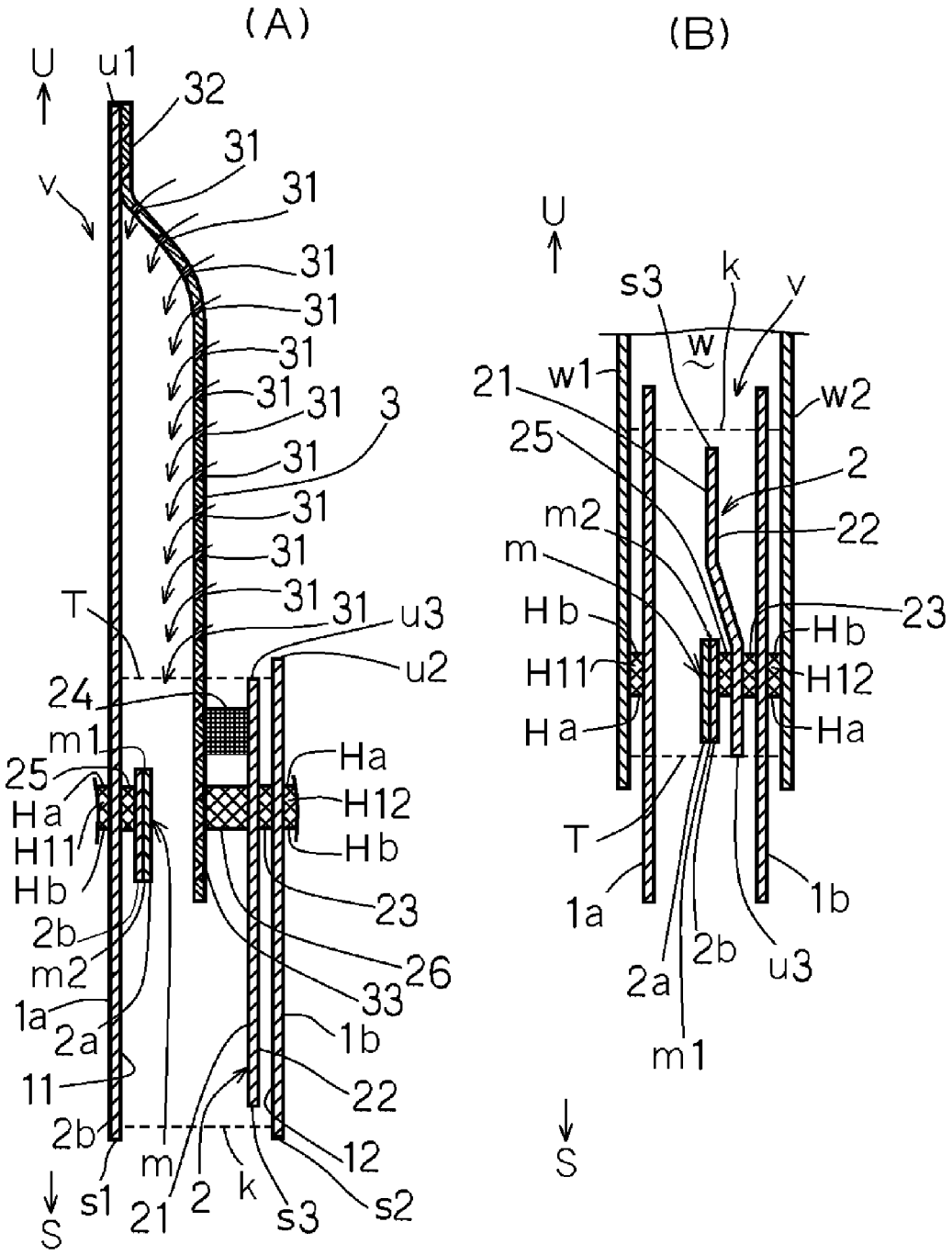
FIG. 6(A) is an end view showing another preferred embodiment.
FIG. 6(B) is an end view showing still another preferred embodiment.

In the illustrated preferred embodiment described above, the valve V discharges a fluid as contents in the sealed bag W to the outside of the sealed bag W, however, the valve V may introduce a fluid as contents into the sealed bag W from the outside of the sealed bag W. When contents are introduced into the sealed bag W from the outside, the valve V is oriented opposite to that shown in FIG. 1 with respect to the sealed bag W, and the valve V is attached to the sealed bag W vertically inversely to the valve shown in FIG. 1(B). This example will be described later with reference to FIG. 6(B).

In particular, in a case where the sealed bag is a balloon, etc., and the valve V introduces contents into the bag from the outside of the sealed bag W, as described above, when the positions of the upstream side end portions u1 and u2 of the first sheet 1*a* and the second sheet 1*b* in the fluid movement direction are made different from each other, the mouth of the valve V can be easily opened by fingertips when a straw is inserted into the valve V to blow air into the sealed bag, the straw can be easily inserted.

Next, a method for attaching the valve V formed as described above to the sealed bag W will be described.

The valve V is attached to the sealed bag W together with manufacturing of the sealed bag W. Hereinafter, attachment of the valve V during manufacturing of the sealed bag W will be mainly described in detail.

Figure 2:
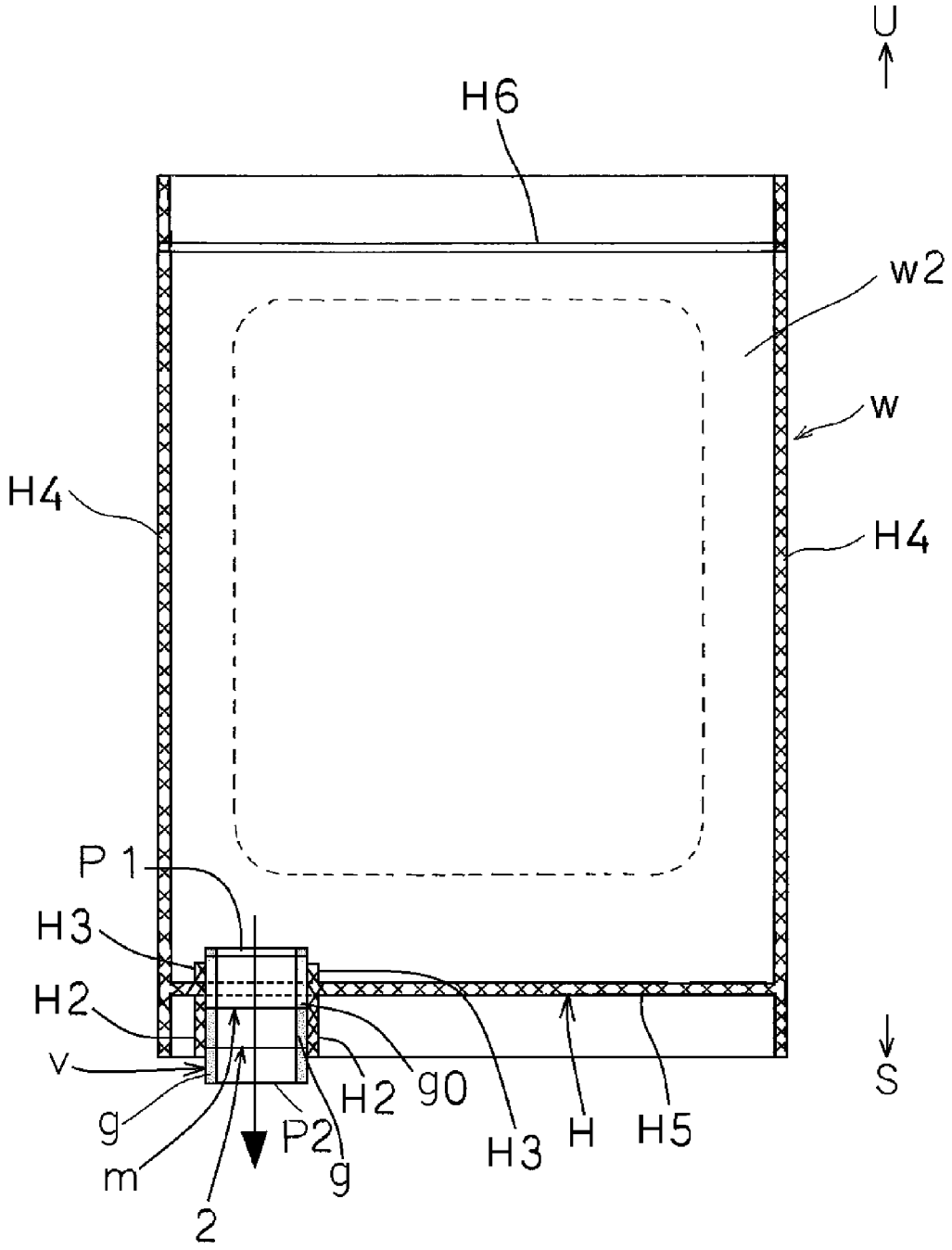
FIG. 2 is an entire front view of a sealed bag according to the preferred embodiment of the present invention.

The sealed bag W is formed by layering two polyethylene sheets W1 and W2 and heat-sealing the peripheral edges of the sheets W1 and W2 (hereinafter, referred to as a first bag sheet W1 and a second bag sheet W2 as appropriate) as shown in FIG. 2, FIG. 3(B), and FIG. 4(A).

In each drawing, the region in which a plurality of diagonal lines cross each other in a lattice pattern shows a bag sealed portion H formed by the above-described heat-sealing of the bag sheets of the sealed bag W.

In addition, in FIG. 2 and FIG. 3(A), the first bag sheet W1 and the first sheet 1*a* on the front side are not shown, and a state viewed through the first bag sheet W1 on the front side is shown.

Figure 3:
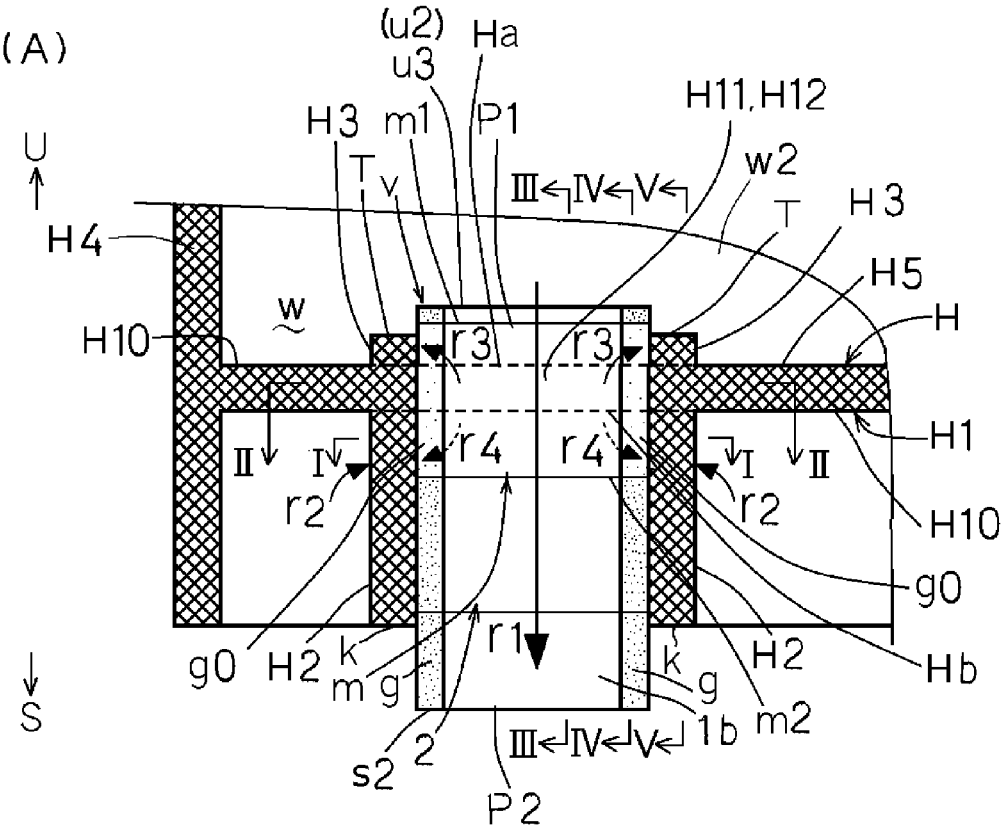
FIG. 3(A) is a partially cut-away essential portion enlarged schematic sectional view of FIG. 1.
FIG. 3(B) is a schematic sectional view taken along line I-I in FIG. 3(A).
Figure 3:
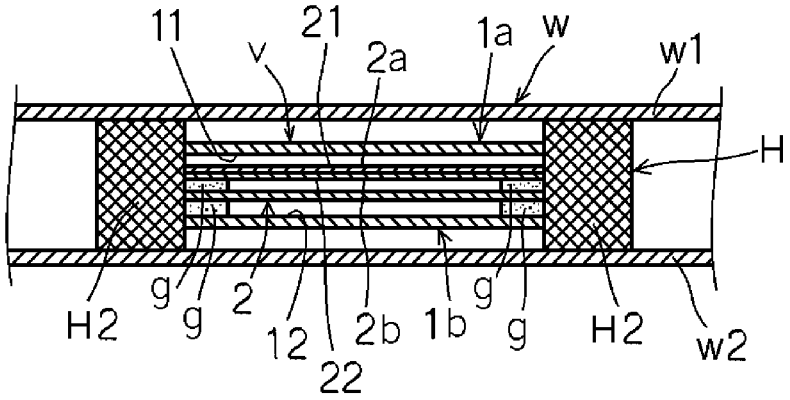
Figure 4:
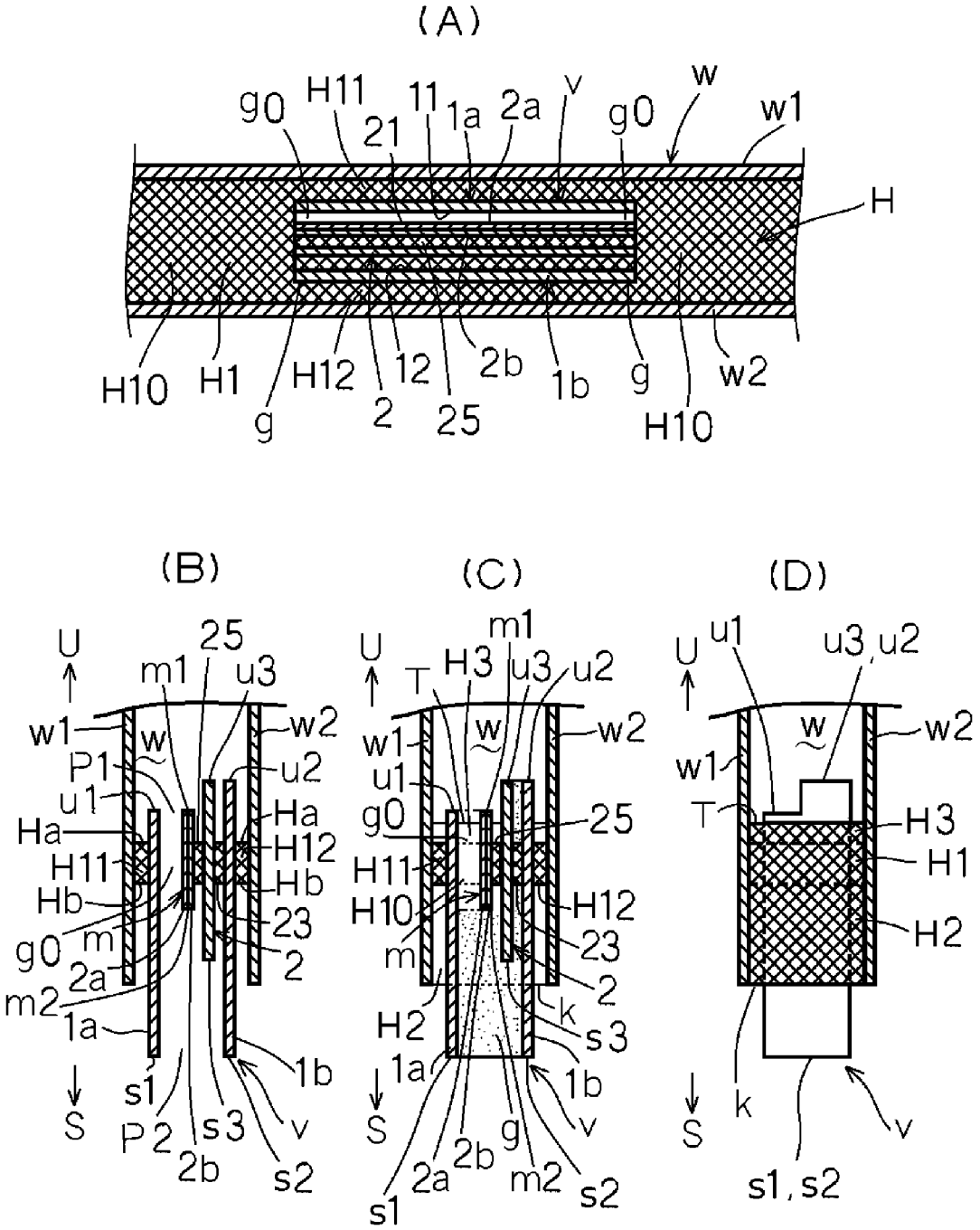
FIG. 4(A) is a schematic sectional view taken along line II-II in FIG. 3.
FIG. 4(B) is a schematic sectional view taken along line in FIG. 3.
FIG. 4(C) is a schematic sectional view taken along line IV-IV in FIG. 3.
FIG. 4(D) is a schematic sectional view taken along line V-V in FIG. 3.

In manufacturing of the sealed bag W, when heat-sealing the first bag sheet W1 and the second bag sheet W2 to each other, the valve V shown in FIG. 1 is attached to the sealed bag W by this heat sealing concurrently with formation of the sealed bag W as shown in FIG. 2 to FIG. 4.

Detailed description is as follows.

FIG. 3(A) shows the vicinity at which the valve V is provided on the lower end side of the sealed bag W. The bag sealed portion H includes, as shown in FIG. 3(A), a main sealed portion H1, first extended portions H2 and H2, and second extended portions H3 and H3.

This main sealed portion H1 is the partition seal of the claims, and is equivalent to the above-described partition seal H1.

The main sealed portion H1, that is, the partition seal H1 includes longitudinal seals H4 and H4 and the transverse seal H5. The longitudinal seals H4 and H4 seal the left and right of the first bag sheet W1 and the left and right of the second bag sheet W2 to each other, respectively. The transverse seal H5 seals the lower side of the first bag sheet W1 and the lower side of the second bag sheet W2 to each other. In the present preferred embodiment, as shown in FIG. 2, on the upper sides of the first bag sheet W1 and the second bag sheet W2, a fastener H6 is provided. However, it is also possible that the upper sides of the first bag sheet W1 and the second bag sheet W2 are sealed in the same manner as the other sides.

The transverse seal H5 extends in the left-right lateral direction along the lower end sides of the bag sheets W1 and W2 layered together as shown in FIG. 3(A) and FIG. 4(A). The main sealed portion Hi is formed across the valve V disposed on the lower end sides of the bag sheets W1 and W2.

In detail, the transverse seal H5 includes, as shown in FIG. 4(A), principal portions H10 and H10 positioned on the left and right of the valve V, and further includes a first branch portion H11 and a second branch portion H12 branched to the front side and back side of the valve V and formed across the valve V.

The principal portions H10 and H10 directly seal the inner surface side of the first bag sheet W1 forming the front side of the sealed bag W and the inner surface side of the second bag sheet W2 forming the back side of the sealed bag W. The end portions in the lateral direction of the principal portions H10 and H10, that is, the left end of the principal portion H10 positioned on the right side of the valve V and the right end of the principal portion H10 positioned on the left side of the valve V are brought into contact with the left and right ends of the valve V, respectively, to seal the points in contact with the valve V.

The first branch portion H11 welds the outer side surface of the first sheet 1*a* of the valve V to the inner side surface of the first bag sheet W1. The second branch portion H12 welds the outer side surface of the second sheet 1*b* of the valve V to the inner side surface of the second bag sheet W2. As shown in FIG. 4(B) and FIG. 4(C), by forming the main sealed portion H1, together with the formation of the second branch portion H12, the above-described fixation portion 23 that welds the second sheet 1*b* and the valve sheet 2 to each other is formed, and further, the above-described auxiliary fixation portion 25 that welds the opposed surface 21 of the valve sheet 2 and the weldable film 2*b* of the seal limiting sheet m is formed.

The non-welded portions g0 are provided in at least the fluid movement direction (up-down direction) to coincide with the transverse seal H5 across the valve V, that is, the first and second branch portions H11 and H12, or provided across a range including these portions.

The first extended portions H2 and H2 correspond to the side-entering preventive sealed portions of claims 3 and 4.

In detail, the first extended portions H2 and H2 are formed continuously to the principal portions H10 and H10 of the transverse seal H5, and are brought into close contact with the left and right end sides of the valve V and extend to the downstream side in the forward flow of the fluid, that is, downward from the principal portions H10 and H10. The first extended portions H2 and H2 seal the portions in close contact with the valve V below the principal portions H10 and H10 of the transverse seal H51. As shown in FIG. 3(A) and FIG. 4(D), the downstream side end portions k that are the tip ends of the first extended portions H2 and H2 are positioned on the more downstream side than the downstream side end portion m2 of the seal limiting sheet m in the fluid movement direction. Specifically, the lower ends of the first extended portions H2 and H2 are positioned lower than the downstream side end portion m2 of the seal limiting sheet m.

The second extended portions H3 and H3 correspond to the side-entering preventive sealed portions of claim 4, and the second extended portions H3 and H3 are formed continuously to the principal portions H10 and H10 of the transverse seal H5, and are brought into close contact with the left and right end sides of the valve V and extend to the upstream side in the forward flow of the fluid, that is, upward from the principal portions H10 and H10.

As shown in FIG. 3(A), in the fluid movement direction, that is, in the up-down direction, the downstream side end portion k of the first extended portion H2 is positioned on the more downstream side than the non-welded portion g0, that is, the downstream side end portion m2 of the seal limiting sheet m. However, the downstream side end portion k of the first extended portion H2 may coincide with the downstream side end portion of the non-welded portion g0, that is, the downstream side end portion m2 of the seal limiting sheet min the up-down direction that is the fluid movement direction.

On the other hand, the upstream side end portion T of the second extended portion H3 is positioned lower than the non-welded portion g0, that is, the upstream side end portion m1 of the seal limiting sheet m as shown in FIG. 3(A), however, the upstream side end portion T may be positioned on the more upstream side than the upstream side end portion m1 of the seal limiting sheet m or coincide with the upstream side end portion m1 of the seal limiting sheet m.

In particular, it is preferable that the non-welded portion g0, that is, the seal limiting sheet m is disposed between the downstream side end portion k of the first extended portion H2 and the upstream side end portion T of the second extended portion H3 in the fluid movement direction.

As shown in FIG. 3(A), the partition seal H1 does not coincide with the extensions of the first and second bag sheets W1 and W2, but are positioned inward relative to the extensions. Specifically, the transverse seal H5 does not coincide with the lower ends of the first and second bag sheets W1 and W2, but are positioned higher than the lower ends.

For example, the fluid movement direction in the forward flow may be reverse to the fluid movement direction shown in FIG. 3(A) with respect to the inside and outside of the bag, that is, may be turned upside down. In detail, it is possible that, when the movement of the fluid from the outside of the sealed bag W to the inside of the sealed bag W is the forward flow, the main sealed portion H1, that is, the transverse seal H5 is positioned inward (upward) relative to the extensions of the first and second bag sheets W1 and W2, and similar to the first extended portions H2 and H2 in FIG. 3(A), the tip ends of the second extended portions H3 and H3, that is, the upstream side end portions T and T can be made to coincide with the extensions. However, when the movement of the fluid from the outside of the sealed bag W to the inside of the sealed bag W is the forward flow, the lower end of the main sealed portion H1 that is the partition seal H1 may be made to coincide with the extensions of the sheets W1 and W2. In this case, it is a matter of course that the second extended portions H3 and H3 cannot be provided.

The first extended portions H2 and H2 preferably protrude out to the side sealed portion g sides of the valve V and overlap the side sealed portions g in the lateral direction orthogonal to the fluid movement direction, that is, the extending direction of the principal portions H10 and H10. Similarly, the second extended portions H3 and H3 also preferably protrude out to the side sealed portion g sides of the valve V and overlap the side sealed portions g. Due to this overlap of each extended portion with the valve sheet 2 side, the sealed bag W can be more reliably sealed.

The effects of the first extended portions H2 and H2 and the second extended portions H3 and H3 will be described in greater detail. As shown by the solid arrow in FIG. 3(A), in use of the manufactured sealed bag W, when a fluid as contents in the sealed bag is discharged to the outside of the bag, the main flow r1, that is, the forward flow of the fluid is downward from the upper side. However, as described above, at the time of heat-sealing for forming the side sealed portions g, at the side seals between the non-weldable film 2*a* and the second sheet 1*b*, the non-welded portions g0 that are not sealed exist, and during movement of the fluid, the outside air r2 and r2 enters the inside of the sealed bag W from the non-welded portions g0. The first extended portions H2 block the entry of air from the outside instead of the side seals between the non-weldable film 2*a* and the second sheet 1*b*.

Further, the air r3 and r3 that entered the inside of the fluid channel can be prevented by the second extended portions H3 and H3 from exiting from the left and right of the channel and entering the inside of the sealed bag W on the more upstream side in the fluid forward flow than the partition seal H1, that is, the main sealed portion H1 of the non-welded portions g0.

In the example shown in FIG. 3(A), the upstream side end portion T of the second extended portion H3 is positioned on the more downstream side than the non-welded portion g0, that is, the upstream side end portion m1 of the seal limiting sheet m as described above, and does not completely cover the non-welded portion g0 on the upstream side of the partition seal H1 in the fluid movement direction. However, by providing the second extended portion H3, the air that enters the inside of the sealed bag W from the fluid channel can be reduced to be smaller than in the case where the second extended portion H3 is not provided. In particular, for more reliably restricting the entry of air, it is preferable that the upstream side end portion T of the second extended portion H3 is positioned on the more upstream side, that is, higher than the upstream side end portion m1 of the seal limiting sheet m or disposed at the same position as the upstream side end portion m1 of the seal limiting sheet m although this is not shown. Of course, if the air r2 and r2 is reliably prevented from entering by the first extended portions H2 and H2, it becomes unnecessary to prevent the air r3 and r3 from entering by the second extended portions H3 and H3, and the second extended portions H3 and H3 may not be provided. However, by forming the second extended portions H3 and H3, even if the first extended portions H2 and H2 are not properly formed due to manufacturing errors, air can be reliably prevented from entering.

By forming the first extended portions H2 and H2, as shown by the dashed arrows in FIG. 3(A), not only can the air r2 and r2 be prevented from flowing into the bag, but also side leaks r4 and r4 of the fluid as contents in the bag can be prevented.

In the above-described preferred embodiment, the first extended portions H2 are formed together with formation of the main sealed portion H1. It is also possible that the first extended portions H2 are formed separately of formation of the main sealed portion H1. For example, it is also possible that after the main sealed portion H1 is formed by heat-sealing, heat-sealing is further applied to form the first extended portions H2. Similar to formation of the first extended portions H2, the second extended portions H3 can also be formed together with or separately of formation of the main sealed portion H1.

In the preferred embodiments described above, one valve V provides one fluid movement channel. Besides this, it is also possible that when sealing the bag sheets, a plurality of fluid channels are formed by providing an auxiliary sealed portion between the side sealed portions g and g although this is not shown. The auxiliary sealed portion extends up and down along the fluid movement direction between the side sealed portions g and g, and by spacing this from the side sealed portions g and g, a plurality of fluid channels are formed.

Other preferred embodiments are shown in FIG. 5(B) and FIG. 5(C).

As shown in FIG. 5(B), the seal limiting sheet m on the valve sheet 2 may not be provided on the valve sheet 2 but may be provided on the first sheet 1*a* to which the valve sheet 2 is not fixed. In addition, in FIG. 5(B), the valve sheet 2 is fixed to the second sheet 1*b* to be welded to the second bag sheet W2, and the weldable film 2*b* side of the seal limiting sheet m is fixed to the first sheet 1*a* to be welded to the first bag sheet W1. Besides these, it is also possible that the valve sheet 2 is fixed to the first sheet 1*a*, and the seal limiting sheet m is fixed to the second sheet 1*b*.

Further, as shown in FIG. 5(C), it is also possible that two seal limiting sheets m are prepared, and the seal limiting sheets m are provided on both of the valve sheet 2 and the first sheet 1*a* on which the valve sheet 2 is not provided. Specifically, the seal limiting sheet m may be provided in the fluid movement direction on portions corresponding to the first branch portion H11 and the second branch portion H12 of both of the first sheet 1*a* and the valve sheet 2.

The valve V shown in FIG. 1 to FIG. 4 and FIG. 5(A), FIG. 5(B), and FIG. 5(C) is a check valve, however, as described above, the valve V is not limited to a check valve. For example, as shown in FIG. 5(D), it is also possible that the valve V is formed of first and second sheets 1*a* and 1*b* side-sealed to each other, and a fluid channel is formed between the opposed surfaces of the sheets 1*a* and 1*b*, and the fluid is restricted from moving by close-contact of the first and second sheets 1*a* and 1*b* with each other. The seal limiting sheet m may be provided so as to include portions corresponding to the first branch portion H11 and the second branch portion H12 of the main sealed portion H1 of the first sheet 1*a* or the second sheet 1*b* of the valve V that does not include the valve sheet 2, or to coincide with the main sealed portion H1. The valve V that does not include the valve sheet 2 may be configured so that the seal limiting sheet m is provided on each of the first sheet 1*a* and the second sheet 1*b* as shown in FIG. 5(E).

In the case of the valve V including the valve sheet 2, the valve sheet 2 is not limited to one sheet. As shown in FIG. 5(F), it is also possible that the valve sheet 2 is provided on each of the inner side surfaces of the first and second sheets 1*a* and 1*b*, and the portion between the two valve sheets 2 and 2 forms one section of the fluid channel.

In the example shown in FIG. 5(F), the seal limiting sheets m and m are provided on the two valve sheets 2 and 2, respectively, however, the seal limiting sheet m may be provided only on the valve sheet 2 provided on the first sheet 1*a* side or only on the valve sheet 2 provided on the second sheet 1*b*.

In the preferred embodiments shown in FIG. 5(B) to FIG. 5(F), matters not especially mentioned are the same as in the preferred embodiment shown in FIG. 1 to FIG. 4 and FIG. 5(A).

As shown in FIG. 6(A), a filter sheet 3 may be provided for the first and second sheets 1*a* and 1*b* so as to filtrate the fluid.

In the valve V shown in FIG. 6(A), the filter sheet 3 is provided at the opening of the valve V on the sealed bag W side, and a fluid moving in the valve V always passes through pores 31 . . . 31 of the filter sheet 3 with a plurality of the pores 31 . . . 31. As the filter sheet 3, for example, nonwoven fabric can be adopted, and other members having a filtration function can also be adopted.

In detail, in the example shown in FIG. 6(A), the position of the upstream side end portion u2 of the second sheet 1*b* to which the valve sheet 2 is fixed is set to be lower than the upstream side end portion u1 of the first sheet 1*a*, and the filter sheet 3 is attached across the upstream side end portion u3 of the valve sheet 2 and the upstream side end portion u1 of the first sheet 1*a*. Specifically, in the example shown in FIG. 6(A), the upper end of the second sheet 1*b* to which the valve sheet 2 is fixed is positioned lower than the upper end of the first sheet 1*a*, and the filter sheet 3 is attached across the upstream side end portion u3 of the valve sheet 2 and the upstream side end portion u1 of the first sheet 1*a*.

In detail, the upper end of the filter sheet 3 is fixed to the opposed surface 11 side of the upstream side end portion u1 of the first sheet 1*a*.

The lower end of the filter sheet 3 is fixed to the opposed surface 21 of the valve sheet 2 by formation of the fixation portion 24. However, the position of the filter sheet 3 is not limited to the attaching position of the filter sheet 3 shown in FIG. 6(A) as long as the filter sheet 3 is disposed at a position that the fluid passes through. For example, the configurations of the first sheet 1*a* and the second sheet 1*b* may be reversed.

The above-described fixation of the filter sheet 3 can be performed by using an adhesive. This fixation of the filter sheet 3 to the valve constituting sheet is performed when forming the valve V before attaching the valve V to the sealed bag W.

In the example shown in FIG. 6(A), similar to the filter sheet 3, the valve sheet 2 is welded to or attached by an adhesive to the second sheet 1*b* before attaching the valve V to the sealed bag W.

By forming the bag sealed portion H when attaching the valve V to the sealed bag W, the valve sheet 2 and the second sheet 1*b* are welded to each other at the fixation portion 23. By forming the bag sealed portion H, the auxiliary fixation portion 26 is formed between the opposed surface 21 of the valve sheet 2 and the filter sheet 3, and the valve sheet 2 and the filter sheet 3 are welded to each other.

By forming the bag sealed portion H, the seal limiting sheet m is welded to the opposed surface 11 of the first sheet 1*a*. Matters not especially mentioned in the preferred embodiment shown in FIG. 6(A) are the same as in the preferred embodiments of FIG. 1 to FIG. 5.

In the preferred embodiments described above, the valve V is provided on the lower end of the sealed bag W, however, the valve V may be provided on another portion of the sealed bag W, for example, on the upper end, the left end, or the right end of the sealed bag W, or without limiting to these peripheral edge portions, the valve V may be provided on the front side or back side of the sealed bag W.

The sealed bag W contains a fluid such as a gas, a liquid, or a powder, or a mixture thereof, etc. In the preferred embodiments described above, the valve V that is a check valve discharges contents such as a liquid in the sealed bag. As an example of this, this check valve can be used for a package container for foods or a storage bag to be used for storing futons and clothes, etc., by removing air from the inside. However, the use is not limited to these examples.

In the description given above, the sheets constituting the valve V and the sheets constituting the sealed bag W are welded by heat-sealing, respectively. Besides this, these sheets may be welded by high-frequency or ultrasonic waves.

Contrary to the embodiments of FIG. 1 to FIG. 5 and FIG. 6(A), for introducing contents into the sealed bag from the outside, the check valve can also be adopted. As an example of this, there is a balloon that is inflated by introducing air. Besides this, in a cushioning material that utilizes a cushioning effect of a gas sealed within a small partitioned storing portion, the check valve may be used for storing the gas.

Specifically, when the valve V is formed as a check valve, the valve may be configured to restrict a fluid from moving in a direction opposite to the direction shown in FIG. 1 to FIG. 5 and FIG. 6(A), and an example of this is shown in FIG. 6(B).

In the preferred embodiment shown in this FIG. 6(B), the point that the fixation portion 23 is provided on the upstream side end portion u3 side in the forward flow of the fluid of the valve sheet 2 and fixed to the second sheet 1*b*, and the downstream side end portion s3 is a free end in the forward flow of the fluid of the valve sheet 2, is the same as in other preferred embodiments described above, and the point that the non-welded portion g0, that is, the seal limiting sheet m is disposed so as to include the transverse seal H5 of the partition seal H1 in the fluid movement direction is also the same. The point that the downstream side end portions k of the first extended portions H2 and H2 are disposed on the more downstream side than or at the same position as the downstream side end portion m2 of the seal limiting sheet m in the fluid movement direction is also the same as in other preferred embodiments described above.

However, in the preferred embodiment shown in FIG. 6(B), the downstream side in the forward flow of the fluid leads to the inside of the sealed bag, and the upstream side in the forward flow of the fluid leads to the outside of the sealed bag.

In the example shown in FIG. 6(B), the second extended portions H3 and H3 are extended to the lower side that is the upstream side from the transverse seal H5, and the first extended portions H2 and H2 are extended to the upper side that is the downstream side from the transverse seal H5. With this configuration, the fluid to be contained can be restricted from flowing back and leaking to the outside.

As shown in FIG. 6(B), in this example, in the forward flow of the fluid, the upstream side end portion m1 of the seal limiting sheet m that becomes the upstream side end portion of the non-welded portion g0 is the lower end of the seal limiting sheet m. The upstream side end portions Ha of the second extended portions H3 and H3 of the bag sealed portion H are positioned lower than, that is, on the more upstream side than the lower end of the seal limiting sheet m. The downstream side end portions Hb of the first extended portions H2 and H2 of the bag sealed portion H are positioned higher than, that is, on the more downstream side than the upper end of the seal limiting sheet m that is the downstream side end portion m2 of the seal limiting sheet m.

In the preferred embodiment shown in FIG. 6(B), matters not especially mentioned are the same as in the preferred embodiments shown in FIG. 1 to FIG. 5 and FIG. 6(A).

When the valve V is a check valve, instead of preparation of a seal limiting sheet m separate of the valve sheet 2, as shown in FIG. 7(A) and FIG. 7(B), the valve sheet 2 itself may be formed by laminating the non-weldable film 2*a* and the weldable film 2*b*.

The non-weldable film 2*a* is disposed to face the inner side surface of the first sheet 1*a*, that is, the opposed surface 11 of the first sheet 1*a*, and the weldable film 2*b* is disposed to face the second sheet 1*b*. The weldable film 2*b* is fixed to the second sheet 1*b* at the fixation portion 23, and the non-weldable film 2*a* provides the opposed surface 21 of the valve sheet 2.

In the same manner as the seal limiting sheet m, the valve sheet 2 can be formed by sticking two sheets of the non-weldable film 2*a* made of PET and the weldable film 2*b* made of polyethylene together by a known lamination method, for example, lamination using an adhesive other than heat-sealing. Then, the non-weldable film 2*a* side constituting the valve sheet 2 is disposed on the channel side so as to provide the surface on the channel side of the valve sheet 2 in the present preferred embodiment.

Figure 7:
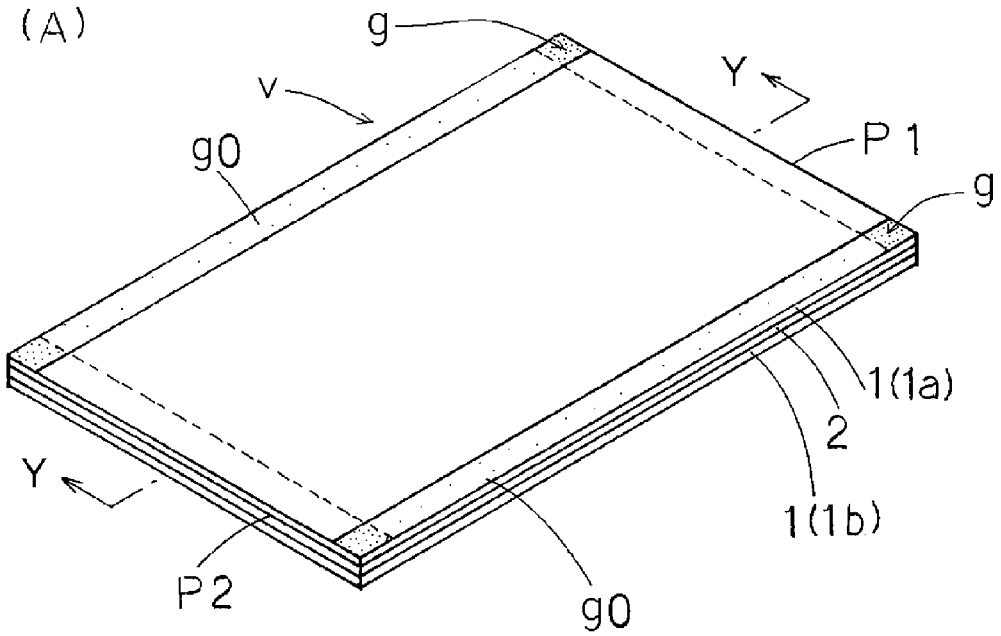
FIG. 7(A) is a perspective view of a valve according to still another preferred embodiment of the present invention before being attached to a sealed bag.
FIG. 7(B) is an end view taken along line Y-Y in FIG. 7(A).
Figure 7:
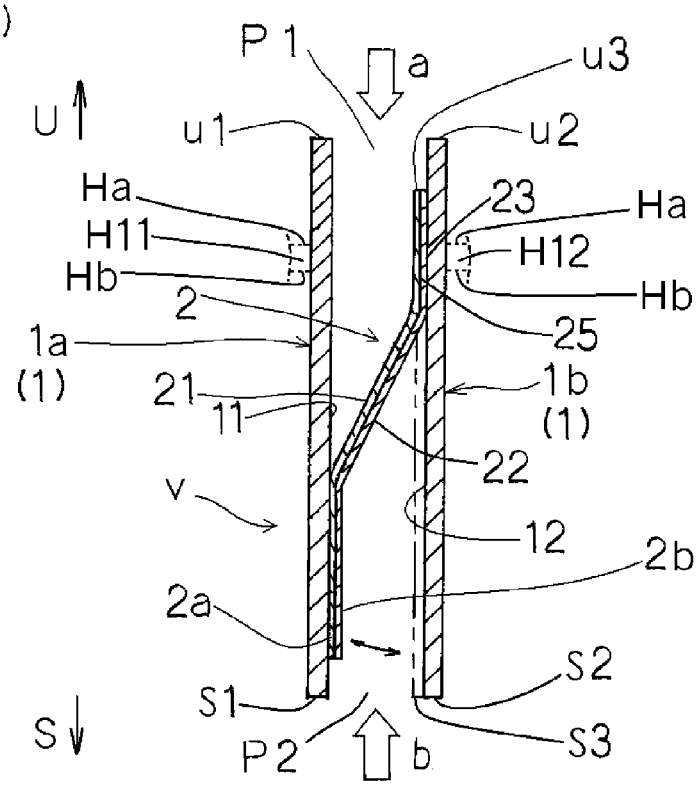

In the preferred embodiment shown in FIG. 7, the entire opposed surface of the valve sheet 2 is the non-welded portion g0.

Figure 5:
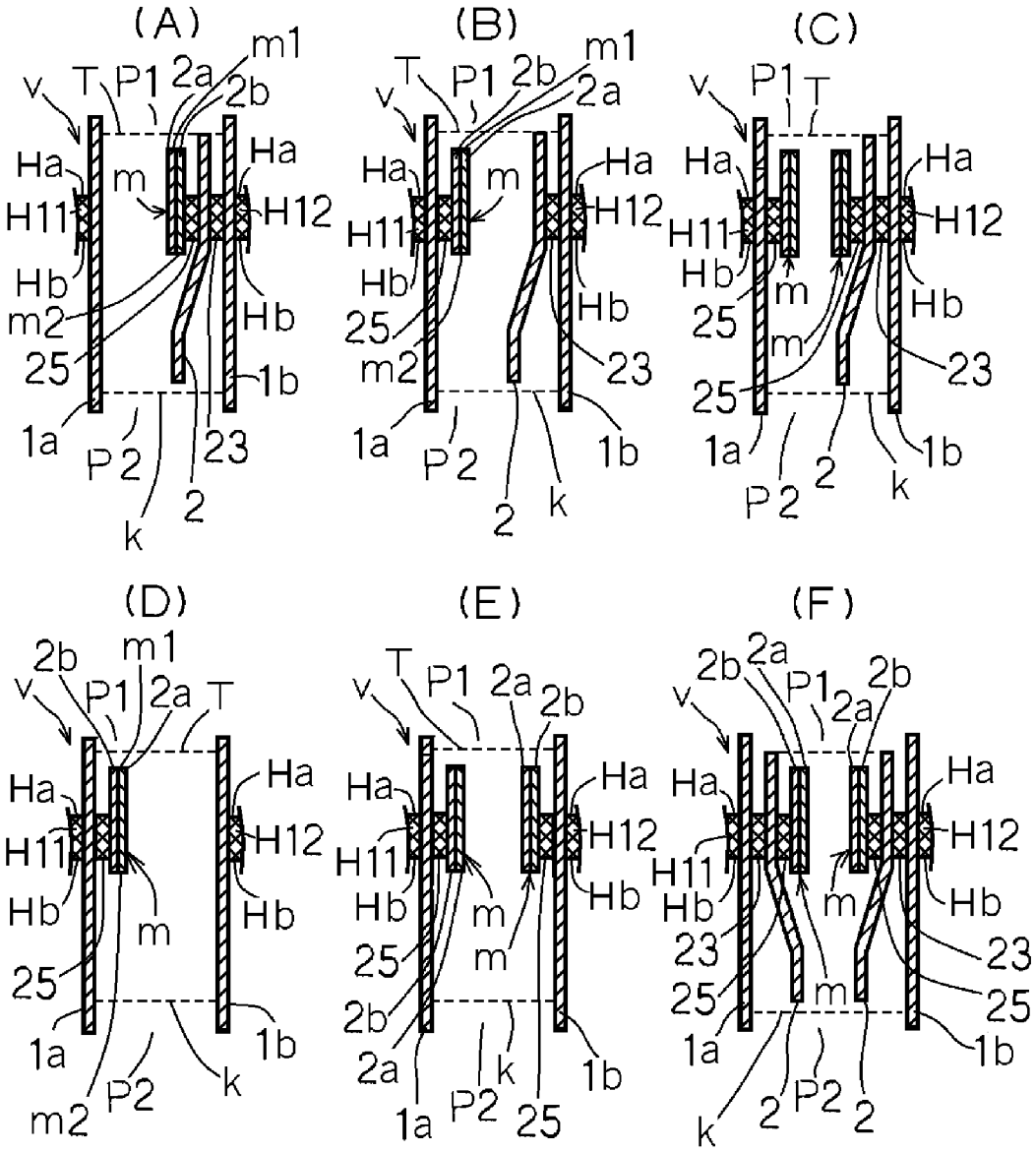
FIG. 5(A) is a schematic end view showing another preferred embodiment of the valve.
FIG. 5(B) is a schematic end view showing still another preferred embodiment of the valve.
FIG. 5(C) is a schematic end view showing still another preferred embodiment of the valve.
FIG. 5(D) is a schematic end view showing still another preferred embodiment of the valve.
FIG. 5(E) is a schematic end view showing still another preferred embodiment of the valve.

In the preferred embodiments shown in FIG. 1 to FIG. 6 (except for FIG. 5(D) and FIG. 5(E)), instead of providing the seal limiting sheet m on the valve sheet 2, the valve sheet 2 itself maybe formed by laminating the non-weldable film 2*a* and the weldable film 2*b* in the same manner as shown in FIG. 7.

In the preferred embodiment shown in FIG. 5(B) to FIG. 5(F), FIG. 6, and FIG. 7, in the fluid movement direction, the widths of the first sheet 1*a* and the second sheet 1*b* are equal to each other, and each position of the upstream side end portions are the same, however, the widths of the first sheet 1*a* and the second sheet 1*b* and the position relationship of the upstream side end portions may be set in the same manner as in the example shown in FIG. 1 to FIG. 4 and FIG. 5(A).

When the seal limiting sheet m is used, the seal limiting sheet m is not limited to be formed of the non-weldable film 2*a* and the weldable film 2*b*, but may be formed of a single non-weldable film, and this non-weldable film may be fixed to the valve constituting sheet according to a known fixing method such as an adhesive other than heat-sealing. In this regard, describing in line with the claims, the non-weldable film is not limited to a film that is laminated on the valve constituting sheet "indirectly" via "another film," that is, a weldable film, and the seal limiting sheet m may be formed of only the non-weldable film 2*a*, and is laminated on the valve constituting sheet "directly" according to a known fixing means such as an adhesive.

When the valve sheet 2 is formed of the non-weldable film 2*a* and the weldable film 2*b*, the non-weldable film 2*a* is required to cover the non-welded portion g0 with respect to the weldable film 2*b*, and does not need to be of the same size as that of the weldable film 2*b* shown in FIG. 7(B).

DESCRIPTION OF THE REFERENCE NUMERAL

1 Outer sheet
2 Valve sheet

What is claimed is:

1. A valve structure comprising:

a valve and a bag body made of sheets, the bag body comprising a partition seal partitioning the bag body into an inside portion and an outside portion, the valve comprising:

a plurality of valve constituting sheets disposed to layer each other;

a fluid movement channel defined by a portion between opposed surfaces of at least two valve constituting sheets opposed to each other and layered together of the plurality of valve constituting sheets;

side seals extending in an up-down direction defined by a movement direction from an upstream side to a downstream side of a fluid to be stored in the bag body, the side seals being provided on a left side and a right side of the fluid movement channel, respectively, and defining a width of the movement channel, the side seals being formed by welding the at least two valve constituting sheets, which define the fluid movement channel, to each other, wherein the fluid movement channel is configured to restrict the fluid to be received in the movement channel from moving when bringing the opposed valve constituting sheets into close contact with each other, the partition seal extends in a direction across the fluid movement channel, and the valve is disposed across the inside portion and the outside portion of the bag body, and welded to the bag body by the partition seal;

a seal limiting sheet is provided on at least one of the opposed surfaces of the at least two valve constituting sheets which define the fluid movement channel, said seal limiting sheet including a non-weldable film on a whole surface thereof, said non-weldable film being positioned within the fluid movement channel and between the at least two valve constituting sheets which define the fluid movement channel, the non-weldable film extending to overlap with the side seals and not being welded to an opposed valve constituting sheet surface that faces the non-weldable film, such that the side seals include non-welded portions at a location where the side seals overlap with the non-weldable film, and such that the partition seal include non-welded portions at a location where the partition seal overlaps with the non-weldable film, wherein the non-weldable film maintains overlapping with the partition seal when the valve is in both an open state where the fluid is allowed to flow in the fluid movement channel, and a closed state where the fluid is restricted from flowing in the fluid movement channel; and side-entering preventive sealed portions provided on a more downstream side than the partition seal in a forward flow of the fluid, and on an outer sides in a left-right direction of the non-welded portions of the side seals, and provided continuously to the partition seal, said side-entering preventive sealed portions being configured to block flows of the fluid into the fluid movement channel from the non-welded portions of the side seals, wherein:

the non-weldable film is not welded by welding of the side seals and the partition seal, a width of the seal limiting sheet in a direction vertical to the up-down direction is equal to a width of the plurality of valve constituting sheets in the direction vertical to the up-down direction, a width of the seal limiting sheet in the up-down direction is larger than a width of the partition seal in the up-down direction, an upper distal end of the seal limiting sheet is provided on a more upstream side than an upper distal end of the partition seal in the up-down direction, a lower distal end of the seal limiting sheet is provided on a more downstream side than a lower distal end of the partition seal in the up-down direction, and a lower distal end of each of the side-entering preventive sealed portions that is extended from the partition seal toward the more downstream side than the partition seal in the up-down direction is provided at the same position as, or on a more downstream side than, the lower distal end of the seal limiting sheet in the up-down direction.

2. The valve structure according to claim 1, wherein the side-entering preventive sealed portions are configured to block flows from the non-welded portions of the side seals into the fluid movement channel and block flows of the fluid from the non-elded portions of the side seals to an outside of the fluid movement channel.

3. The valve structure according to claim 1, wherein the side-entering preventive sealed portions are formed integrally with the partition seal, and extended from the partition seal toward the downstream side in the forward flow.

4. The valve structure according to claim 1, wherein the side-entering preventive sealed portions are formed integrally with the partition seal, and extended from the partition seal toward both the downstream side and the upstream side in the forward flow, and the side-entering preventive sealed portions partially overlap the side seals.

5. The valve structure according to claim 1, wherein the valve is a check valve formed of at least three valve constituting sheets, among the at least three valve constituting sheets, at least two valve constituting sheets are outer sheets, and at least the other one valve constituting sheet is a valve sheet, both outer sheets are layered with the valve sheet therebetween, and on the outer sheets and the valve sheet, the side seals are formed, the valve sheet includes a fixed end on the upstream side in the forward flow fixed to one of the outer sheets, and a free end on the downstream side that is not fixed, and the fluid movement channel is defined by a portion between opposed surfaces of the valve sheet and the other outer sheet or another valve sheet opposed to the valve sheet, and the non-weldable film is laminated on at least one of the opposed surfaces directly or indirectly via another film.

6. The valve structure according to claim 1, wherein the valve is formed of two valve constituting sheets, both valve constituting sheets are formed to be tubular by the side seals, and a portion between opposed surfaces of the two valve constituting sheets is the fluid movement channel, and the non-weldable film is laminated on at least one of the opposed surfaces directly or indirectly via another film.

7. The valve structure according to claim 1, wherein in the fluid movement channel, a filter sheet is provided to filtrate a fluid moving between the valve constituting sheets.

8. A valve structure comprising a valve and a bag body formed of sheets, the bag body comprising a partition seal partitioning the bag body into an inside portion and an outside portion, the valve comprising:

two opposed valve constituting sheets, said two opposed valve constituting sheets being formed to be tubular by side seals;

a fluid movement channel defined by a portion between opposed surfaces of the two opposed valve constituting sheets;

said side seals extending in an up-down direction defined by a movement direction from an upstream side to a downstream side of a fluid to be stored in the bag body, the side seals being provided on a left side and a right side of the fluid movement channel, respectively, and defining a width of the fluid movement channel, the side seals being formed by welding the two opposed valve constituting sheets, which define the fluid movement channel, to each other, wherein the fluid movement channel is configured to restrict the fluid to be received in the movement channel from moving when bringing the two opposed valve constituting sheets into, the partition seal extends in a direction across the fluid movement channel, and the valve is disposed across the inside portion and the outside portion of the bag body, and welded to the bag body by the partition seal;

a seal limiting sheet is provided on at least one of the opposed surfaces of the two opposed valve constituting sheets which define the fluid movement channel, said seal limiting sheet including a non-weldable film on a whole surface thereof, said non-weldable film being positioned within the fluid movement channel and between the two valve constituting sheets which define the fluid movement channel, the non-weldable film extending to overlap with the side seals and not being welded to an opposed valve constituting sheet surface that faces the non-weldable film, such that the side seals include non-welded portions at a location where the side seals overlap with the non-weldable film, and such that the partition seal include non-welded portions at a location where the partition seal overlaps with the non-weldable film, wherein the non-weldable film maintains overlapping with the partition seal when the valve is in both an open state where the fluid is allowed to flow in the fluid movement channel, and a closed state where the fluid is restricted from flowing in the fluid movement channel; and side-entering preventive sealed portions provided on at least one of the inner and outer sides relative to the partition seal, and on outer sides in a left-right direction of the non-welded portions of side seals, and provided continuously to the partition seal, the side-entering preventive sealed portions being configured to block flows of the fluid from the non-welded portions of the side seals into the fluid movement channel, wherein:

the non-weldable film is not welded by welding of the side seals and the partition seal, a width of the seal limiting sheet in a direction vertical to the up-down direction is equal to a width of the plurality of valve constituting sheets in the direction vertical to the up-down direction, a width of the seal limiting sheet in the up-down direction is larger than a width of the partition seal in the up-down direction, an upper distal end of the seal limiting sheet is provided on a more upstream side than an upper distal end of the partition seal in the up-down direction, a lower distal end of the seal limiting sheet is provided on a more downstream side than a lower distal end of the partition seal in the up-down direction, and a lower distal end of each of the side-entering preventive sealed portions that is extended from the partition seal toward the more downstream side than the partition seal in the up-down direction is provided at the same position as, or on a more downstream side than, the lower distal end of the seal limiting sheet in the up-down direction.

9. The valve structure according to claim 2, wherein the side-entering preventive sealed portions are formed integrally with the partition seal, and extended from the partition seal toward the downstream side in the forward flow.

10. The valve structure according to claim 2, wherein the side-entering preventive sealed portions are formed integrally with the partition seal, and extended from the partition seal toward both the downstream side and the upstream side in the forward flow, and the side-entering preventive sealed portions partially overlap the side seals.

11. The valve structure according to claim 2, wherein the valve is a check valve formed of at least three valve constituting sheets, among the at least three valve constituting sheets, at least two valve constituting sheets are outer sheets, and at least the other one valve constituting sheet is a valve sheet, both outer sheets are layered with the valve sheet therebetween, and on the outer sheets and the valve sheet, the side seals are formed, the valve sheet includes a fixed end on the upstream side in the forward flow fixed to one of the outer sheets, and a free end on the downstream side that is not fixed, and the fluid movement channel is defined by a portion between opposed surfaces of the valve sheet and the other outer sheet or another valve sheet opposed to the valve sheet, and the non-weldable film is laminated on at least one of the opposed surfaces directly or indirectly via another film.

12. The valve structure according to claim 3, wherein the valve is a check valve formed of at least three valve constituting sheets, among the at least three valve constituting sheets, at least two valve constituting sheets are outer sheets, and at least the other one valve constituting sheet is a valve sheet, both outer sheets are layered with the valve sheet therebetween, and on the outer sheets and the valve sheet, the side seals are formed, the valve sheet includes a fixed end on the upstream side in the forward flow fixed to one of the outer sheets, and a free end on the downstream side that is not fixed, and the fluid movement channel is defined by a portion between opposed surfaces of the valve sheet and the other outer sheet or another valve sheet opposed to the valve sheet, and the non-weldable film is laminated on at least one of the opposed surfaces directly or indirectly via another film.

13. The valve structure according to claim 4, wherein the valve is a check valve formed of at least three valve constituting sheets, among the at least three valve constituting sheets, at least two valve constituting sheets are outer sheets, and at least the other one valve constituting sheet is a valve sheet, both outer sheets are layered with the valve sheet therebetween, and on the outer sheets and the valve sheet, the side seals are formed, the valve sheet includes a fixed end on the upstream side in the forward flow fixed to one of the outer sheets, and a free end on the downstream side that is not fixed, and the fluid movement channel is defined by a portion between opposed surfaces of the valve sheet and the other outer sheet or another valve sheet opposed to the valve sheet, and the non-weldable film is laminated on at least one of the opposed surfaces directly or indirectly via another film.

14. The valve structure according to claim 2, wherein the valve is formed of two valve constituting sheets, both valve constituting sheets are formed to be tubular by the side seals, and a portion between opposed surfaces of the two valve constituting sheets is the fluid movement channel, and the non-weldable film is laminated on at least one of the opposed surfaces directly or indirectly via another film.

15. The valve structure according to claim 3, wherein the valve is formed of two valve constituting sheets, both valve constituting sheets are formed to be tubular by the side seals, and a portion between opposed surfaces of the two valve constituting sheets is the fluid movement channel, and the non-weldable film is laminated on at least one of the opposed surfaces directly or indirectly via another film.

16. The valve structure according to claim 4, wherein the valve is formed of two valve constituting sheets, both valve constituting sheets are formed to be tubular by the side seals, and a portion between opposed surfaces of the two valve constituting sheets is the fluid movement channel, and the non-weldable film is laminated on at least one of the opposed surfaces directly or indirectly via another film.

17. The valve structure according to claim 2, wherein in the fluid movement channel, a filter sheet is provided to filtrate a fluid moving between the valve constituting sheets.

18. The valve structure according to claim 3, wherein in the fluid movement channel, a filter sheet is provided to filtrate a fluid moving between the valve constituting sheets.

19. The valve structure according to claim 4, wherein in the fluid movement channel, a filter sheet is provided to filtrate a fluid moving between the valve constituting sheets.

20. The valve structure according to claim 5, wherein in the fluid movement channel, a filter sheet is provided to filtrate a fluid moving between the valve constituting sheets.

* * * * *